US010004665B2

(12) United States Patent
Maldonado

(10) Patent No.: US 10,004,665 B2
(45) Date of Patent: Jun. 26, 2018

(54) BABY BOTTLE ASSEMBLY

(71) Applicant: Lisa Maldonado, Hobart, OK (US)

(72) Inventor: Lisa Maldonado, Hobart, OK (US)

( * ) Notice: Subject to any disclaimer, the term of this patent is extended or adjusted under 35 U.S.C. 154(b) by 0 days. days.

(21) Appl. No.: 15/820,375

(22) Filed: Nov. 21, 2017

(65) Prior Publication Data

US 2018/0140510 A1 May 24, 2018

Related U.S. Application Data

(60) Provisional application No. 62/425,823, filed on Nov. 23, 2016.

(51) Int. Cl.

| | |
|---|---|
| ***A61J 9/00*** | (2006.01) |
| ***A61J 11/00*** | (2006.01) |
| ***H04R 1/02*** | (2006.01) |
| ***G08C 17/02*** | (2006.01) |

(52) U.S. Cl.

CPC ..... *A61J 9/00* (2013.01); *A61J 11/006* (2013.01); *A61J 11/008* (2013.01); *G08C 17/02* (2013.01); *H04R 1/028* (2013.01); *A61J 2205/30* (2013.01)

(58) Field of Classification Search

CPC ..... A61J 11/008

See application file for complete search history.

(56) References Cited

U.S. PATENT DOCUMENTS

| | | | | | |
|---|---|---|---|---|---|
| 4,898,060 | A * | 2/1990 | To | A61J 9/00 | 215/11.1 |
| 5,664,745 | A * | 9/1997 | Hadaway | A61J 9/00 | 215/11.1 |
| 6,104,292 | A * | 8/2000 | Rombom | A61J 9/00 | 340/573.1 |
| 6,158,870 | A * | 12/2000 | Ramirez | A61J 9/0607 | 215/11.1 |
| 6,353,391 | B1 * | 3/2002 | Shearer | A61J 9/00 | 340/13.32 |
| 6,413,137 | B1 * | 7/2002 | Myers, Sr. | A63H 5/00 | 215/11.1 |
| 6,778,813 | B1 * | 8/2004 | Lilly | A47G 19/2227 | 220/737 |
| 7,134,932 | B1 * | 11/2006 | Carrasco | A61J 9/00 | 446/227 |
| 7,914,165 | B2 * | 3/2011 | Bertken | A47G 19/2227 | 362/101 |
| 9,560,431 | B1 * | 1/2017 | Lilly | H04R 1/028 | |
| 9,814,331 | B2 * | 11/2017 | Alexander | A47G 19/027 | |
| 2002/0077018 | A1 * | 6/2002 | Rice | A61J 9/00 | 446/74 |
| 2006/0062085 | A1 * | 3/2006 | Evans | A61J 9/00 | 368/10 |
| 2006/0165571 | A1 * | 7/2006 | Seon | A61J 11/008 | 422/302 |
| 2008/0197097 | A1 * | 8/2008 | Montgomery | A61J 9/001 | 215/11.2 |

(Continued)

*Primary Examiner* — Jay Liddle
*Assistant Examiner* — Alex F. R. P. Rada, II
(74) *Attorney, Agent, or Firm* — RG Patent Consulting, LLC; Rachel Gilboy

(57) ABSTRACT

An improved baby bottle assembly that glows in the dark structured and arranged to be located without having to turn on the light, which may make a baby become wide awake. The bottle will also play a soothing melody, to help ease the baby back to sleep.

14 Claims, 4 Drawing Sheets

(56) References Cited

U.S. PATENT DOCUMENTS

| | | | | |
|---|---|---|---|---|
| 2008/0251486 | A1* | 10/2008 | Housley | A61J 9/04 215/11.5 |
| 2009/0224112 | A1* | 9/2009 | Carrasco | A61J 9/06 248/104 |
| 2011/0036801 | A1* | 2/2011 | Krans | A61B 5/02416 215/11.1 |
| 2015/0245723 | A1* | 9/2015 | Alexander | A47G 19/027 99/483 |
| 2015/0335184 | A1* | 11/2015 | Balachandran | A47G 19/2288 219/438 |
| 2017/0042373 | A1* | 2/2017 | Alexander | A47J 36/2472 |
| 2017/0340146 | A1* | 11/2017 | Alexander | A47J 41/0044 |

* cited by examiner

BABY BOTTLE ASSEMBLY

CROSS-REFERENCE TO RELATED APPLICATION

The present application is related to and claims priority from prior provisional application Ser. No. 62/425,823, filed Nov. 23, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of baby bottle devices and more specifically relates to an improved baby bottle assembly that glows in the dark structured and arranged to be located without having to turn on the light, which may make a baby become wide awake. The bottle will also play a soothing melody, to help ease the baby back to sleep.

2. Description of the Related Art

Caring for a new baby entails a great deal of work. When parents are unable to get a good night's sleep, because the baby awakens and needs to be fed, the days are even longer and more difficult. A baby bottle is a bottle with a teat to drink directly from. It is typically used by infants and young children when a mother does not breastfeed, or if someone cannot (as conveniently) drink from a cup, for feeding oneself or being fed. In particular it is used to feed infant formula, expressed breast milk or pediatric electrolyte solution.

Various attempts have been made to solve problems found in baby bottle device art. Among these are found in: U.S. Pat. No. 6,158,870 to John A Ramirez; U.S. Pat. No. 5,344,034 to Chris S. Eagan; U.S. Pat. No. 6,413,137 to Jermaine A. Myers, Sr.; U.S. Pat. No. 5,662,406 to Mattice et al.; and U.S. Publication No. 2006/0061985 to John Elkins. This prior art is representative of baby bottles comprising illuminating and/or audio means.

Ideally, an improved baby bottle assembly should be user-friendly and safe in-use and, yet should operate reliably and be manufactured at a modest expense. Thus, a need exists for an improved baby bottle assembly that glows in the dark structured and arranged to be located without having to turn on the light, which may make a baby become wide awake. The bottle will also play a soothing melody, to help ease the baby back to sleep and to avoid the above-mentioned problems.

BRIEF SUMMARY OF THE INVENTION

In view of the foregoing disadvantages inherent in the known baby bottle device art, the present invention provides an improved baby bottle. The general purpose of the present invention, which will be described subsequently in greater detail is to provide a improved baby bottle assembly that glows in the dark structured and arranged to be located without having to turn on the light, which may make a baby become wide awake. The bottle will also play a soothing melody, to help ease the baby back to sleep.

An improved baby bottle assembly comprising: a main body; a nipple member a cap member; a base member; and a remote controller. The main body includes a bottom surface and at least one side surface. Wherein the at least one side surface is connected to and extends upwardly from said bottom surface. Wherein the at least one side surface has an upper rim portion adapted to releasably connect with a nipple member and a cap member. Wherein the bottom surface and said at least one side surface define an interior volume adapted to hold a liquid therein. Wherein at least one portion of said at least one side surface is formed from a material capable of glowing in the dark.

The nipple member includes a rim portion and a flexible mouth piece. Wherein the flexible mouth piece has an aperture formed therein adapted to allow liquid to pass therethrough. Wherein the rim portion is adapted to releasably connect with the upper rim portion of the at least one side surface of said main body.

The cap member includes a rim portion. The rim portion has is adapted to releasably connect with the upper rim portion of said at least one side surface of the main body. Wherein the cap member removably covers the nipple member.

The base member including: an interior volume, a receiver member, an audio player, a speaker member; audio sensor; and a power source. The receiver member is located within said interior volume and is adapted to receive electronic signals from a remote transceiver. The audio player is located within the interior volume and is electronically connected to the receiver member and is adapted to send music to a speaker member. The speaker member is located on an exterior surface of the base member and is electronically connected to the audio player and is adapted to emit audio sounds. The speaker member is located on an exterior surface of the base member and is electronically connected to the speaker member. The audio sensor is adapted to send an electronic signal to the audio player to turn on the music when audio is detected in a predetermined vicinity of said improved baby bottle assembly. The power source is located within the interior volume and is electronically connected to and adapted to send power to said receiver member, said audio player, and the audio sensor. The base member is adapted to be releasably connected to the bottom surface of the main body.

The remote controller includes an interior volume; a transceiver; an activation button; a signal detector; and a power source. The transceiver is located within the interior volume and is adapted to send electronic signals to the receiver of the base member. The activation button is located on an outer surface of the remote controller, is electronically connected to the transceiver, and is adapted to remotely turn on and off the audio player of the base member. The signal detector is located on an outer surface of the remote controller, is electronically connected to the transceiver, and is adapted to receive signals from and allow an alternate controller to remotely turn on and off said audio player of said base member. The power source is located within the interior volume and is electronically connected to and adapted to send power to the transceiver, the activation button, and the signal detector remote controller is adapted to remotely turn on and off the audio player of the base member.

The present invention holds significant improvements and serves as an improved baby bottle assembly. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, improved baby bottle assembly, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a baby bottle device and more particularly to an improved baby bottle assembly that glows in the dark structured and arranged to be located without having to turn on the light, which may make a baby become wide awake. The bottle will also play a soothing melody, to help ease the baby back to sleep Generally speaking, the improved baby bottle assembly is a brand-new baby bottle that will make late-night and middle-of-the-night feedings easier for the parents and their babies. It is made of a light-weight plastic that does not contain BPA or phthalates, which can be harmful to the health of babies. The bottles are initialized, so parents and care providers will know which bottle to use with which baby. This will help to eliminate spreading germs from a sick child to a well child. It is also important to identify the ownership of a bottle when a child needs a special formula due to specific allergies and intolerances.

The exterior surface of the bottle and the cap are made from a material that glows in the dark. This will make it easier to find without having to turn on the light and awakening the baby fully. It will also facilitate finding a bottle, which may have rolled off the bed or become entangled in the covers. There is a music player attached to the base of the bottle, which will play a soothing melody to help lull a fussy baby back to sleep as it feeds. This base is removable, so the bottle can be washed without damaging the music player. The materials used for this bottle will be tested to ensure they are safe for babies, and parents may be able to program or select the kind of music they would like to be played. This bottle comes with a remote that activates the music player, making it even easier to locate a missing bottle. This bottle will be available in various colors, including pink for baby girls and green or blue for baby boys.

Figure 1:
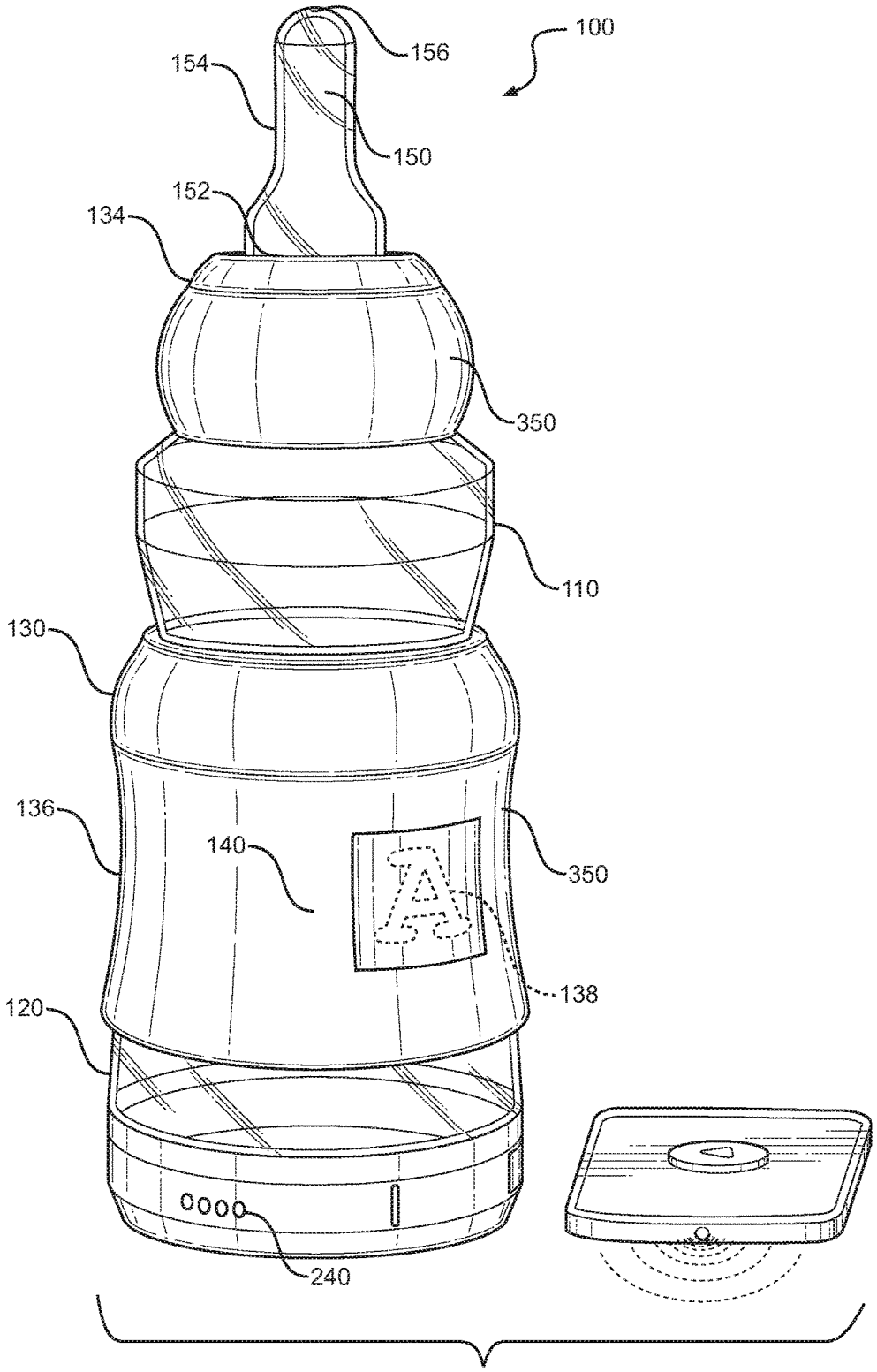
FIG. 1 shows a perspective view illustrating an improved baby bottle assembly according to an embodiment of the present invention.
Figure 2:
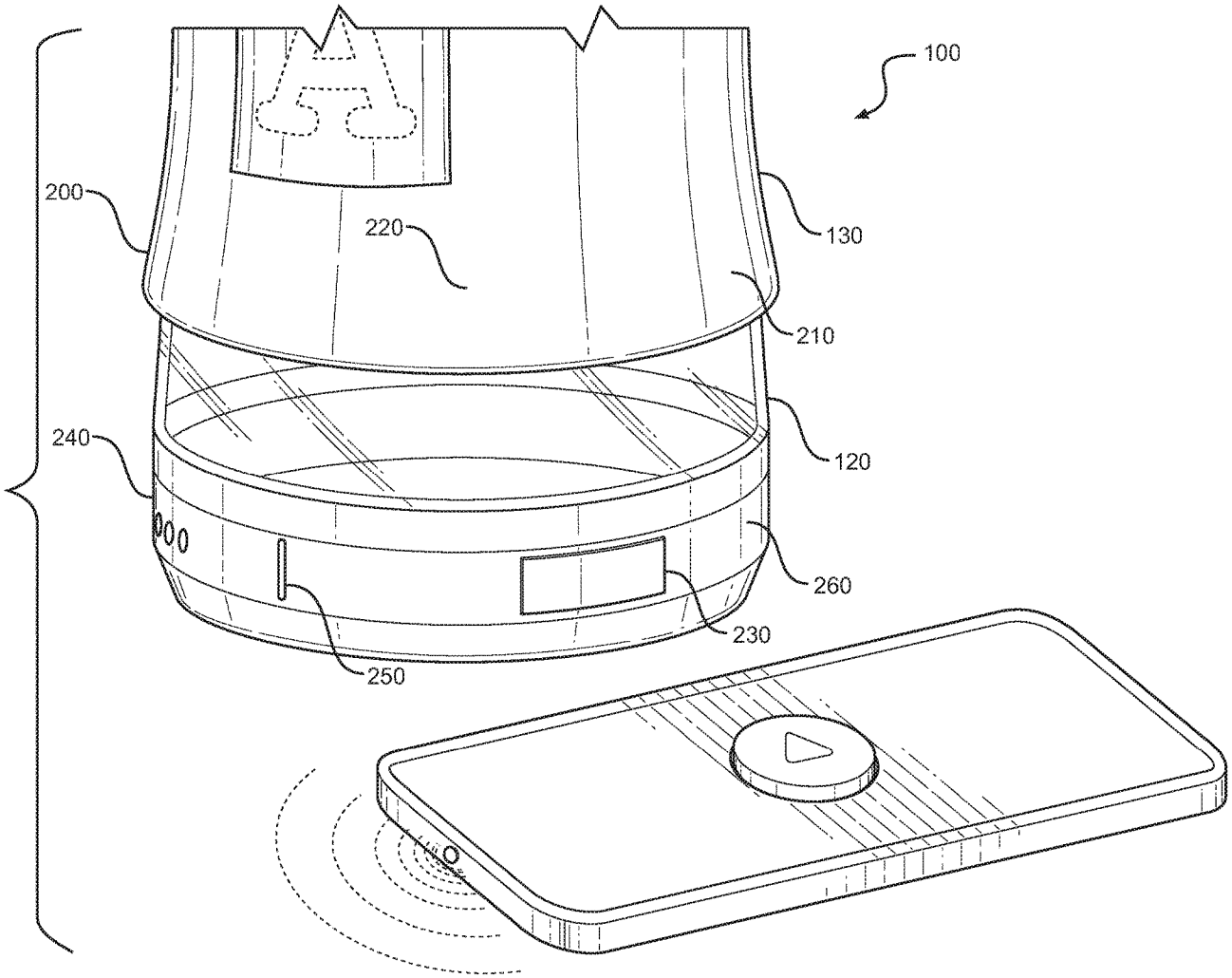
FIG. 2 is a perspective view illustrating a base member of the improved baby bottle assembly according to an embodiment of the present invention.
Figure 3:
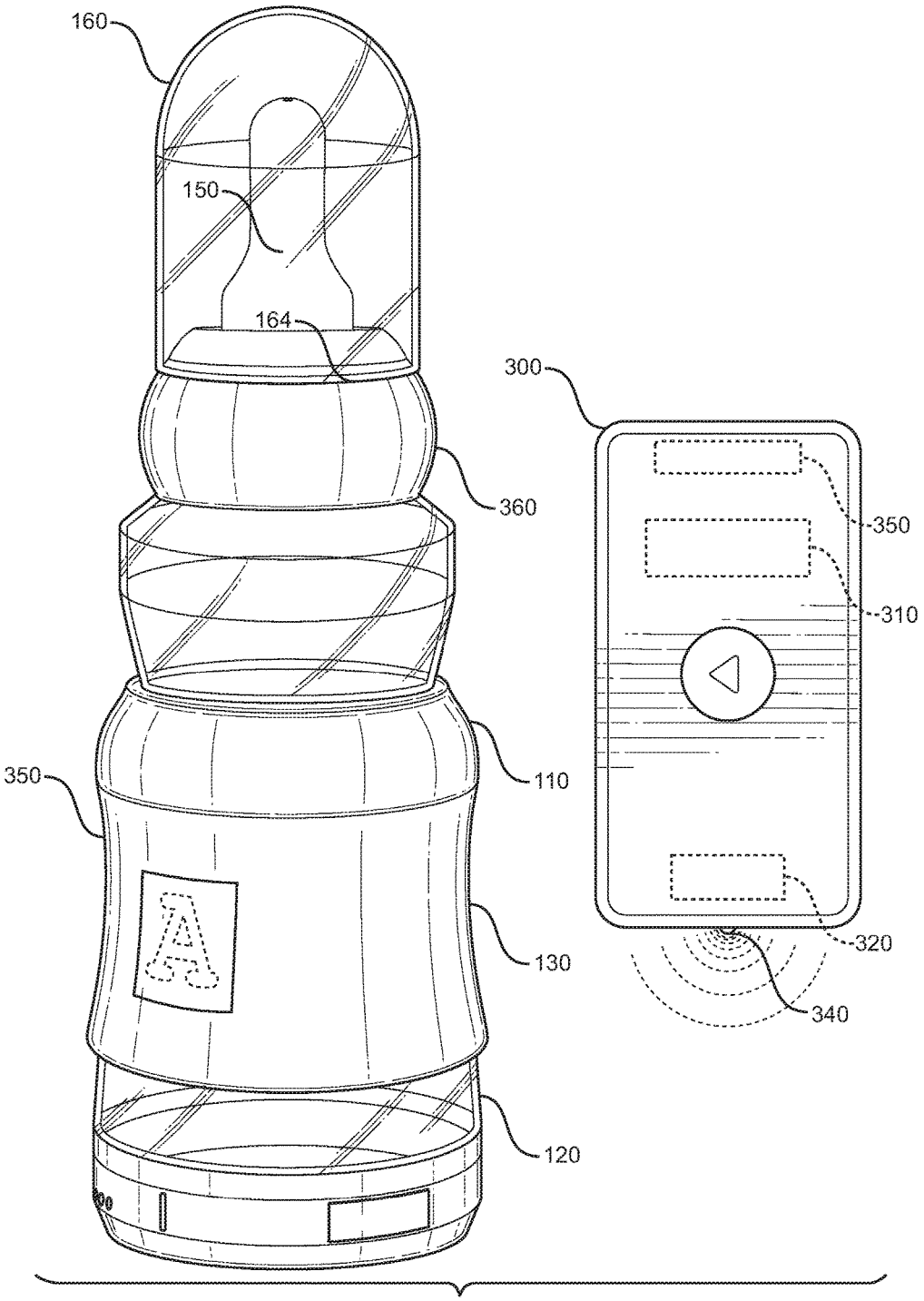
FIG. 3 is a perspective view illustrating another view of the improved baby bottle assembly according to an embodiment of the present invention of FIG. 1.
Figure 4:
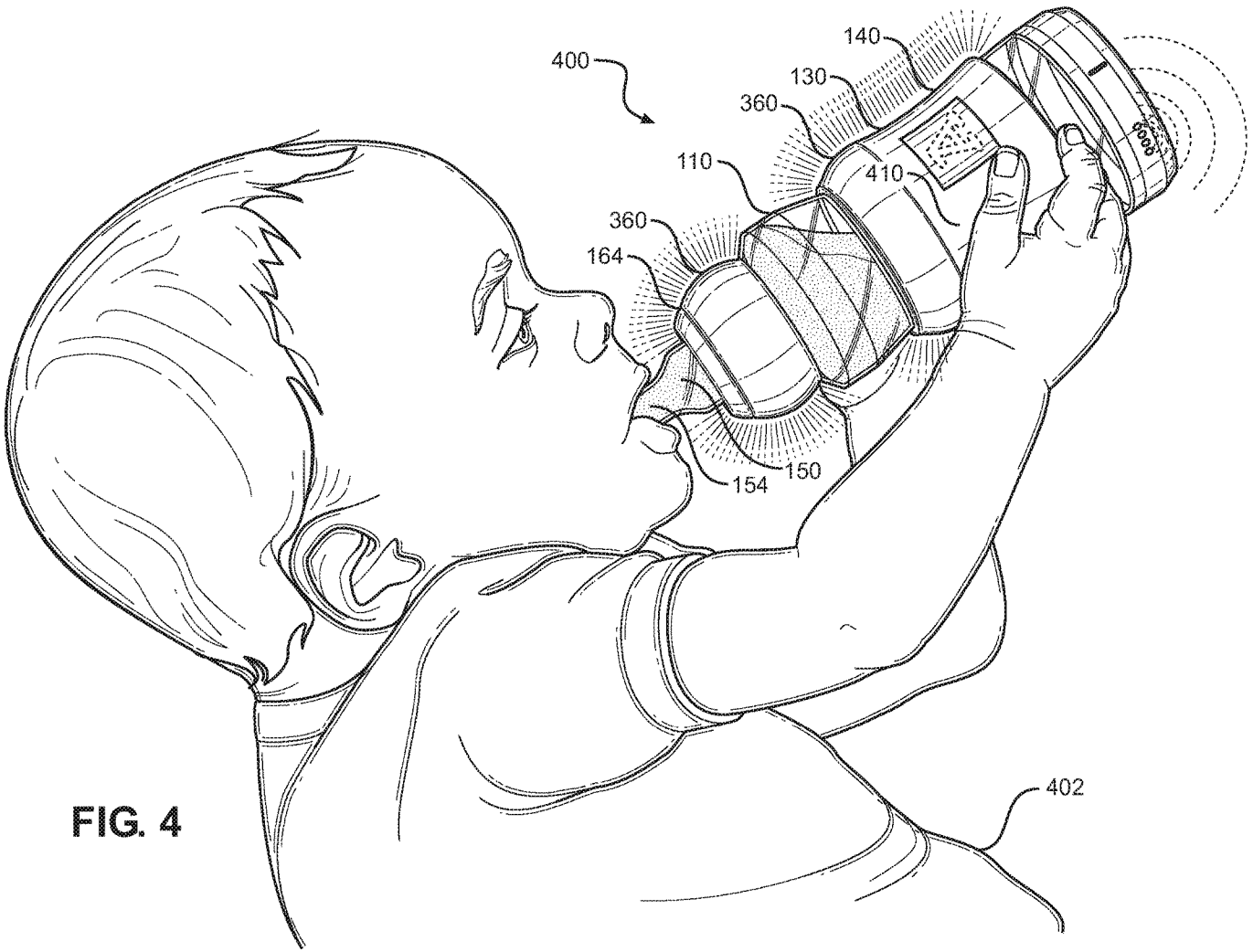
FIG. 4 is a perspective view illustrating the improved baby bottle assembly in an in-use condition according to an embodiment of the present invention of FIG. 1.

The unique features of this invention will provide the following benefits for parents and care provider of small children:

- A new baby bottle to make it easier to feed babies during the night
- Can be found easily in dark room because it glows in the dark
- Each bottle can be identified by the baby's initial, to eliminate sharing germs or using the wrong bottle
- Both babies and their parents will be able to get back to sleep easier, when they do not have to turn on the light when feeding the baby
- The soothing lullaby will help to relax a cranky baby
- Using the remote to activate the music will make it easier to find a missing bottle
- The remote also glows in the dark, so it can be found easily when needed Referring now to FIGS. 1-4, showing perspective views illustrating improved baby bottle assembly 100 according to an embodiment of the present invention of FIG. 1.

Improved baby bottle assembly 100 comprising: main body 110; nipple member 150; cap member 160; base member 200; and remote controller 300. Main body 110 includes bottom surface 120 and at least one side surface 130. Wherein at least one side surface 130 is connected to and extends upwardly from bottom surface 120. Wherein at least one side surface 130 has upper rim portion 134 adapted to releasably connect with nipple member 150 and cap member 160. Wherein bottom surface 120 and at least one side surface 130 define interior volume 140 adapted to hold liquid 410 therein as shown in in-use condition 400 with baby 402 drinking from improved baby bottle assembly 100 of FIG. 4. Wherein interior volume 140 of main body 110 is substantially cylindrical. Wherein base member 200 is formed having a circular cross-section. Wherein main body 110 and nipple member 150 may be formed from a phthalate-free plastic material. Wherein main body 110 and nipple member 150 are formed from a bisphenol-free plastic material. Wherein main body 110 and nipple member 150 may be formed from a phthalate-free and bisphenol-free plastic material.

Wherein at least one portion 136 of at least one side surface 130 is formed from a material capable of glowing in the dark. Wherein at least one portion 136 of at least one side surface 130 that is formed from a material capable of glowing in the dark further includes indicia 138 thereon adapted to allow a person to identify the user of improved baby bottle assembly 100. Wherein there are two portions 360 of at least one side surface 130 that is formed from a material capable of glowing in the dark as shown in FIG. 1. Wherein two portions 360 are spaced from one another. Wherein at least one portion 136 of at least one side surface 130 is formed from a silicone material. Wherein two portions 360 of at least one side surface 130 is formed from a silicone material. Wherein said material capable of glowing in the dark is chosen from a group of materials capable of glowing in the dark consisting of phosphorus, quinine, and fluorescent dyes.

Nipple member 150 includes rim portion 152 and flexible mouth piece 154. Wherein flexible mouth piece 154 has aperture 156 formed therein adapted to allow liquid 410 to pass therethrough. Wherein rim portion 152 is adapted to releasably connect with upper rim portion 134 of at least one side surface 130 of main body 110.

Cap member 160 includes rim portion 164. Rim portion 164 has is adapted to releasably connect with upper rim portion 134 of at least one side surface 130 of main body 110. Wherein cap member 150 removably covers nipple member 150. Cap member 160 is formed from a translucent material.

Base member 200 including: interior volume 210, receiver member 220, audio player 230, speaker member 240; audio sensor 250; and power source 260. Receiver member 220 is located within interior volume 210 and is adapted to receive electronic signals from remote transceiver 320. Audio player 230 is located within interior volume 210 and is electronically connected to receiver member 220 and is adapted to send music to speaker member 240. Speaker member 240 is located on an exterior surface of base member 200 and is electronically connected to audio player 230 and is adapted to emit audio sounds. Speaker member 240 is located on an exterior surface of base member 200 and is electronically connected to speaker member 240. Audio sensor 250 is adapted to send an electronic signal to audio player 230 to turn on the music when audio is detected in a predetermined vicinity of improved baby bottle assembly 100. Power source 260 is located within interior volume 210 and is electronically connected to and adapted to send power to receiver member 220, audio player 230, and audio sensor 250. Base member 200 is adapted to be releasably connected to bottom surface 120 of main body 110.

Improved baby bottle assembly 100 further includes motion detector 270. Motion detector 270 is located on an exterior surface of base member 200 and is electronically connected to speaker member 240 and power source 270. Motion detector 280 is adapted to send an electronic signal to audio player 230 to turn on music when motion is detected in a predetermined vicinity of improved baby bottle assembly 100.

Remote controller 300 includes interior volume 310; transceiver 320; activation button 330; signal detector 340; and power source 350. Transceiver 320 is located within interior volume 310 and is adapted to send electronic signals to receiver 220 of base member 200. Activation button 330 is located on an outer surface of remote controller 300, is electronically connected to transceiver 320, and is adapted to remotely turn on and off audio player 230 of base member 200. Signal detector 340 is located on an outer surface of remote controller 300, is electronically connected to transceiver 320, and is adapted to receive signals from and allow an alternate controller to remotely turn on and off audio player 230 of base member 200. Power source 350 is located within interior volume 310 and is electronically connected to and adapted to send power to transceiver 320, activation button 330, and signal detector 340 of remote controller 300 is adapted to remotely turn on and off audio player 230 of base member 200.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved baby bottle assembly comprising:

a main body including:
- a bottom surface; and
- at least one side surface;
  - wherein said at least one side surface is connected to and extends upwardly from said bottom surface;
  - wherein said at least one side surface has an upper rim portion adapted to releasably connect with a nipple member and a cap member;
  - wherein said bottom surface and said at least one side surface define an interior volume adapted to hold a liquid therein; and
  - wherein at least one portion of said at least one side surface is formed from a material capable of glowing in the dark;

a nipple member including:
- a rim portion; and
- a flexible mouth piece;
  - wherein said flexible mouth piece has an aperture formed therein adapted to allow liquid to pass there through;
- wherein said rim portion is adapted to releasably connect with said upper rim portion of said at least one side surface of said main body;

a cap member including:
- a rim portion;
- wherein said rim portion has is adapted to releasably connect with said upper rim portion of said at least one side surface of said main body; and wherein said cap member removably covers said nipple member; and a base member including:
- an interior volume;
- a receiver member;
  - wherein said receiver member is located within said interior volume and is adapted to receive electronic signals from a remote transceiver;
- an audio player;
  - wherein said audio player is located within said interior volume and is electronically connected to said receiver member and is adapted to send music to a speaker member;
- a speaker member;
  - wherein said speaker member is located on an exterior surface of said base member and is electronically connected to said audio player and is adapted to emit audio sounds;

an audio sensor;

wherein said speaker member is located on an exterior surface of said base member and is electronically connected to said speaker member; and wherein said audio sensor is adapted to send an electronic signal to said audio player to turn on said music when audio is detected in a predetermined vicinity of said improved baby bottle assembly; and a first power source;

wherein said first power source is located within said interior volume and is electronically connected to and adapted to send power to said receiver member, said audio player, and said audio sensor;

wherein said base member is adapted to be releasably connected to said bottom surface of said main body; and a remote controller including:

an interior volume;

a transceiver;

wherein said transceiver is located within said interior volume and is adapted to send electronic signals to said receiver of said base member;

an activation button;

wherein said activation button is located on an outer surface of said remote controller, is electronically connected to said transceiver, and is adapted to remotely turn on and off said audio player of said base member;

a signal detector;

wherein said signal detector is located on an outer surface of said remote controller, is electronically connected to said transceiver, and is adapted to receive signals from and allow an alternate controller to remotely turn on and off said audio player of said base member; and a second power source;

wherein said second power source is located within said interior volume and is electronically connected to and adapted to send power to said transceiver, said activation button, and said signal detector;

wherein said remote controller is adapted to remotely turn on and off said audio player of said base member.

2. The improved baby bottle assembly of claim 1, further including:

a motion detector;

wherein said motion detector is located on an exterior surface of said base member and is electronically connected to said speaker member and said first power source; and wherein said motion detector is adapted to send an electronic signal to said audio player to turn on said music when motion is detected in a predetermined vicinity of said improved baby bottle assembly.

3. The improved baby bottle assembly of claim 1, wherein said at least one portion of said at least one side surface that is formed from a material capable of glowing in the dark further includes indicia thereon adapted to allow a person to identify the user of said improved baby bottle assembly.

4. The improved baby bottle assembly of claim 1, wherein there are two portions of said at least one side surface that is formed from a material capable of glowing in the dark.

5. The improved baby bottle assembly of claim 4, wherein said two portions are spaced from one another.

6. The improved baby bottle assembly of claim 3, wherein said at least one portion of said at least one side surface is formed from a silicone material.

7. The improved baby bottle assembly of claim 5, wherein said two portions of said at least one side surface is formed from a silicone material.

8. The improved baby bottle assembly of claim 1, wherein said material capable of glowing in the dark is chosen from a group of materials capable of glowing in the dark consisting of phosphorus, quinine, and fluorescent dyes.

9. The improved baby bottle assembly of claim 1, wherein said interior volume of said main body is substantially cylindrical.

10. The improved baby bottle assembly of claim 1, wherein said base member is formed having a circular cross-section.

11. The improved baby bottle assembly of claim 1, wherein said cap member is formed from a translucent material.

12. The improved baby bottle assembly of claim 1, wherein said main body and said nipple member are formed from a phthalate-free plastic material.

13. The improved baby bottle assembly of claim 1, wherein said main body and said nipple member are formed from a bisphenol-free plastic material.

14. The improved baby bottle assembly of claim 1, wherein said main body and said nipple member are formed from a phthalate-free and bisphenol-free plastic material.

* * * * *